US005245847A

United States Patent [19]

Bando et al.

[11] Patent Number: 5,245,847

[45] Date of Patent: Sep. 21, 1993

[54] PROCESS FOR ZINC ELECTROPLATING OF ALUMINUM STRIP

[75] Inventors: Seiji Bando, Hannan; Yoshihiko Hoboh, Osaka; Naotaka Ueda, Wakayama; Masanori Tsuji, Wakayama; Kazuyuki Fujita, Wakayama; Hisao Yoshimori, Wakayama, all of Japan

[73] Assignee: Sumitomo Metal Industries, Ltd., Osaka, Japan

[21] Appl. No.: 832,082

[22] Filed: Feb. 6, 1992

[30] Foreign Application Priority Data

Feb. 7, 1991 [JP] Japan ..... 3-16602
May 22, 1991 [JP] Japan ..... 3-117648

[51] Int. Cl.[5] ..... C25D 5/44; C25D 7/06

[52] U.S. Cl. ..... 72/47; 205/139; 205/172; 205/213; 205/222

[58] Field of Search ..... 205/139, 172, 213, 222; 72/47

[56] References Cited

U.S. PATENT DOCUMENTS 3,098,804 7/1963 Wittrock ..... 204/41
3,359,189 12/1967 Cooke et al. ..... 204/28
3,915,811 10/1975 Tremmel et al. ..... 204/33
4,097,342 6/1978 Cooke et al. ..... 204/28
4,169,770 10/1979 Cooke et al. ..... 204/28
4,437,944 3/1984 Bruno et al. ..... 204/27
4,495,008 1/1985 Bruno et al. ..... 148/31.5
4,681,668 7/1987 Davies ..... 204/28
4,969,980 11/1990 Yoshioka et al. ..... 204/28
4,975,337 12/1990 Hyner et al. ..... 428/648
5,015,340 5/1991 Colombier et al. ..... 204/28

FOREIGN PATENT DOCUMENTS 51-64429 6/1976 Japan .
57-203994 4/1982 Japan .
61-157693 7/1986 Japan .
290903 5/1928 United Kingdom .

*Primary Examiner*—John Niebling
*Assistant Examiner*—William T. Leader
*Attorney, Agent, or Firm*—Burns, Doane, Swecker & Mathis

[57] ABSTRACT

A process for zinc electroplating of aluminum strip which can be performed continuously at a high speed and a high current density. The process comprises subjecting aluminum strip to anodic electrolysis in an acidic solution which may be an acidic plating bath solution or a pickling solution before the strip is subjected to cathodic electrolysis in an acidic zinc plating bath to perform zinc electroplating.

17 Claims, 2 Drawing Sheets

PROCESS FOR ZINC ELECTROPLATING OF ALUMINUM STRIP

BACKGROUND OF THE INVENTION

This invention relates to a process for zinc electroplating of aluminum strip. More particularly, it is concerned with a process for preparing zinc- or zinc alloy-plated aluminum strip which has a plated coating having good adhesion to the aluminum substrate and which is suitable for use in the manufacture of automobile bodies by continuous direct electroplating at a high speed.

Aluminum sheet has begun to be employed in automobile bodies for the purposes of saving weight and thereby reducing fuel consumption. It is known that aluminum sheet which has been plated with zinc or a zinc alloy is suitable for use in such applications, since chemical conversion treatment such as phosphating or chromating can be easily performed on such plated aluminum sheet prior to finish paint coating. See Japanese Patent Application Laid-Open (Kokai) No. 61-157693 (1986).

However, there was no commercial process established in the prior art for direct electroplating of aluminum strip with zinc or a zinc alloy in a continuous manner at a high speed.

Aluminum and its alloys have high surface activity and form on the surface thereof a firm oxide film which is readily regenerated after removal. The presence of such an oxide film on the surface significantly inhibits the adhesion of a plated coating formed thereon. Therefore, when aluminum strip is electroplated, it has been considered necessary in the prior art to subject the aluminum strip to special pretreatment in order to remove the oxide film prior to electroplating.

For this purpose, displacement plating (also called immersion plating) with zinc or a zinc alloy is widely employed. This pretreatment method comprises forming a thin layer of zinc or a zinc alloy such as a Zn-Ni, Zn-Cu, or Zn-Fe alloy on the surface of aluminum strip (which is made of aluminum or an aluminum alloy) by means of displacement plating before the desired zinc electroplating is performed. The pretreatment method is performed by a process comprising the following steps, for example:

Degreasing with an organic solvent→Alkaline degreasing →Rinsing→Etching→Rinsing→Acid dipping→Rinsing →First Zn or Zn alloy displacement plating→Rinsing→Acid dipping→Rinsing→Second Zn or Zn alloy displacement plating→Rinsing→Strike Co or Ni plating.

The Zn or Zn alloy displacement plating is performed by immersing aluminum strip in a plating bath. Examples of compositions of useful plating baths and the immersion conditions are as follows:

(1) 120 g/l of sodium hydroxide, 20 g/l of zinc oxide, 2 g/l of crystalline ferric chloride, 50 g/l of Rochelle salt, and 1 g/l of sodium nitrate, 21°-24° C., immersion period of 30 seconds.

(2) 120 g/l of sodium hydroxide, 20 g/l of zinc oxide, 1-2 g/l of nickel cyanide, and 1 g/l of cuprous cyanide, 27°-30° C., immersion period of 20-60 seconds.

(3) 500 g/l of sodium hydroxide, 100 g/l of zinc oxide, 1 g/l of crystalline ferric chloride, and 10 g/l of Rochelle salt, 16°-27° C., immersion period of 30-60 seconds.

Pretreatment of aluminum strip by such a displacement plating method involves the following problems.

(a) The displacement plating is performed twice, leading to an increased number of steps. Furthermore, the Zn or Zn alloy plated coating formed by the first displacement plating is dissolved out into an acid in the subsequent acid dipping step prior to the second displacement plating. Therefore, it is a waste of resources and increases the costs required for waste water treatment.

(b) The plating bath used in each displacement plating is an alkaline bath containing a toxic substance such as a cyanide or Rochelle salt and requires more complicated bath control than an acidic plating bath such as a sulfate bath.

(c) It takes a relatively long period of 20-60 seconds to complete the desired displacement in each displacement plating step. As a result, an overall treating period of from about 3 minutes to about 13 minutes is required to proceed from the solvent degreasing step to the second displacement plating step. Therefore, the pretreatment method significantly interferes with the production efficiency.

Consequently, when zinc electroplating is applied to aluminum strip in a continuous plating line in which the aluminum strip is pretreated by the above-described method prior to the desired electroplating, it is impossible to attain a high line speed and a high efficiency as realized in a similar continuous electroplating line for steel strip. If a continuous electroplating line for aluminum strip having a line speed as high as that employed in electroplating of steel strip is constructed, it will have a line length which is several times as long as the length of an electroplating line for steel strip.

Accordingly, there is a need for a direct zinc electroplating method for aluminum strip which eliminates the pretreatment procedure comprising displacement plating.

Japanese Patent Application Laid-Open (Kokai) No. 51-64429(1976) describes pretreating aluminum strip by anodizing so as to form an anodic oxide film containing a heavy metal such as copper as an impurity, which serves as a nucleus in the subsequent electrodeposition of zinc plating. This pretreatment, however, requires 10 to 45 minutes to complete anodizing and significantly interferes with the efficiency of plating.

Japanese Patent Publication No. 57-20399(1982) discloses a process for electroplating aluminum strip which comprises immersing aluminum strip in an alkaline solution or a hydrofluoric acid-containing acidic solution and then treating it in a mixed acid to roughen the surface of the strip before the strip is electroplated. According to that process, the oxide film formed on the surface of the aluminum strip is removed by immersing the strip in the alkaline or acidic solution and the surface is then roughened by dissolution with the mixed acid in order to assure good adhesion of a plated coating formed in the subsequent electroplating step to the aluminum strip substrate.

Also in that process, it takes a long pretreatment period of 55-165 seconds to remove the surface oxide film and roughen the surface. Therefore, the process is not suitable for continuous plating at a high speed since it requires a long plating line. In an example in that Japanese Patent Publication, aluminum strip is electroplated with zinc using a borofluoride bath. However, the current density employed in that example is very low, i.e., on the order of 6 A/dm$^2$. Accordingly, although the process is a kind of direct plating, it does not provide a high-speed, continuous plating process.

SUMMARY OF THE INVENTION

It is an object of this invention to enable a high-speed, continuous electroplating technique, which is already established for electroplating of steel strip, to be performed on aluminum strip.

Another object of the invention is to overcome the major problem in direct electroplating of aluminum strip and provide an electroplated coating having good adhesion to the aluminum strip.

A more specific object of the invention is to provide a process for direct zinc electroplating of aluminum strip which is capable of forming an electroplated coating having improved adhesion to the aluminum strip substrate by high-speed continuous plating.

In order to enable a high-speed, continuous zinc electroplating technique established for steel strip to be performed on aluminum strip, the present inventors have searched for process conditions for zinc electroplating of aluminum strip under which the requirements of good plating adhesion and high-speed continuous electroplating which thus far have been considered to be incompatible requirements, are satisfied simultaneously.

As a result, it has been found that the electroplating conditions have much greater effects on the plating adhesion than the pretreatment conditions, which were considered to be important in the prior art batchwise electroplating of aluminum strip, and that high-speed continuous zinc electroplating with significantly improved plating adhesion can be realized by subjecting aluminum strip, whether pretreated or not, to anodic electrolysis prior to zinc electroplating.

In general, the present invention resides in a process for zinc electroplating of aluminum strip comprising subjecting aluminum strip to anodic electrolysis in an acidic solution followed by cathodic electrolysis in an acidic zinc plating bath to perform zinc electroplating on the aluminum strip.

Specifically, the process comprises pretreating aluminum strip by alkaline degreasing and then pickling and subjecting the pretreated aluminum strip to zinc electroplating by cathodic electrolysis in an acidic zinc plating bath, wherein the aluminum strip is subjected to anodic electrolysis in an acidic solution prior to the cathodic electrolysis. The resulting zinc electroplated coating has improved adhesion to the aluminum strip substrate.

In a preferred embodiment, the anodic electrolysis is carried out for a period between 0.2 and 180 seconds at a voltage of 300 V or less. In order to ultimately obtain a plated coating of good appearance, it is desirable that the anodic electrolysis be performed in an acidic solution having a pH of 4 or less, which may be either an acidic plating bath solution which is used in the subsequent cathodic electrolysis or a pickling solution which is used to pretreat the aluminum strip prior to electroplating, although other acidic solutions may be used in anodic electrolysis.

The term "aluminum strip" used herein encompasses strip of pure aluminum metal and strip of an aluminum alloy such as Al-Mg, Al-Mg-Si, Al-Cu, or the like which has an Al content of at least 50% by weight. The aluminum strip may be either in a coiled form or a sheet form.

Similarly, the terms "zinc electroplating", "zinc plating", and "zinc plated coating" used herein refer to electroplating or electroplated coating with either zinc or a zinc alloy.

DESCRIPTION OF THE INVENTION

In a preferred embodiment, the present invention comprises pretreating aluminum strip by alkaline degreasing and then pickling and subjecting the pretreated aluminum strip to anodic electrolysis in an acidic zinc plating bath followed by cathodic electrolysis in the same bath for electroplating, resulting in the formation of a zinc plated coating having improved adhesion to the aluminum substrate.

The pretreatment (alkaline degreasing and pickling) may be performed in the same manner under the same conditions as conventionally employed for electroplating steel strip. Typically, it-is performed as follows:

(1) alkaline degreasing: mainly conducted electrolytically using an approximately 3–7 wt % aqueous solution of sodium orthosilicate ($Na_4SiO_4$) or sodium hydroxide (NaOH), bath length of about 6–12 m, treating period of about 3–6 seconds;

(2) rinsing (washing with water);

(3) pickling: mainly conducted by dipping but sometimes electrolytically using a sulfuric acid solution in most cases or a hydrochloric acid solution in some cases in a concentration of about 6–10 wt %, bath length of about 5–12 m, treating period of about 2–10 seconds; and (4) rinsing.

However, it is not critical to pretreat aluminum strip in the above-described manner prior to anodic electrolysis. The aluminum strip may be pretreated in another way or may not be pretreated.

The effects of anodic electrolysis of aluminum strip are not clear at present, but they are assumed to be as follows.

Aluminum and its alloys have high surface activity and are highly reactive with oxygen. Therefore, their surface is readily covered with a thin oxide film when exposed to air. It is estimated that the oxide film is partially removed by alkaline degreasing and pickling during the pretreatment stage. However, it is readily regenerated on the aluminum surface before the aluminum is subjected to electroplating. Therefore, an electroplated coating is formed on such oxide film, which is the main cause of poor adhesion of the plated coating.

However, in the process according to the invention, aluminum strip which has been pretreated in a conventional manner is initially subjected to anodic electrolysis in an acidic zinc plating bath before it is electroplated by cathodic electrolysis in that bath. As a result, the adhesion of the resulting electroplated coating is significantly improved compared to that obtained in a conventional pretreatment process such as alkaline degreasing followed by pickling.

Figure 1:
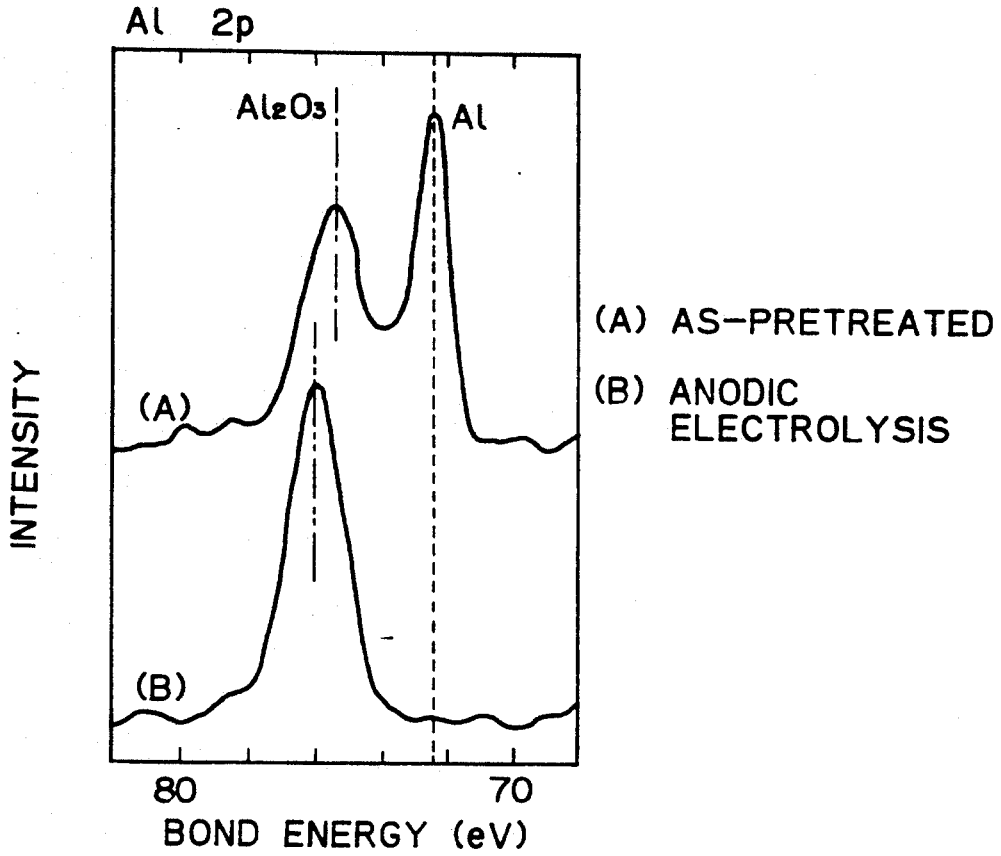
FIG. 1 shows the Al 2P spectra of aluminum strip pretreated by a conventional process (A) or by further anodic electrolysis (B) when measured by XPS after a sample was sputtered with argon gas for 2 minutes.

FIG. 1 shows the Al 2P spectra of pretreated aluminum strip measured by X-ray photoelectron spectroscopy (XPS) after the surface of a sample was sputtered with argon gas for 2 minutes to a depth of about 100 angstroms as measured from the surface. The aluminum strip used was pretreated by a conventional process which was the same as employed in the example, i.e., by alkaline electrolytic degreasing in a 7 wt % sodium orthosilicate solution at 80° C. followed by pickling in 8 wt % HCl at 80° C. Spectrum (A) was obtained with a sample of the as-pretreated aluminum strip, i.e., pretreated by a conventional process. Spectrum (B) was obtained with a sample which had been subjected to anodic electrolysis for 3.0 seconds in an acidic zinc plating bath (Zn=90 g/l, pH=1.8) at 50° C. with a current density of 50 A/dm$^2$ according to this invention after the above-described pretreatment.

As can be seen from this figure, a peak of Al is observed in the spectrum of the as-pretreated sample (A) at a bond energy around 72.4 eV in addition to a peak of $Al_2O_3$. This means that at least a portion of the oxide film formed on the surface of the aluminum strip has a thickness of less than about 100 angstroms. In contrast, no peak of Al is observed in the spectrum of the anodically electrolyzed sample (B), but only a peak of $Al_2O_3$ is found after sputtering for 2 minutes, indicating that the anodic electrolysis in an acidic plating bath causes dissolution of the oxide film formed on the surface of the aluminum strip along with a part of the underlying aluminum metal and subsequent formation of an anodized film having a thickness of about 100 angstroms or greater.

Figure 2:
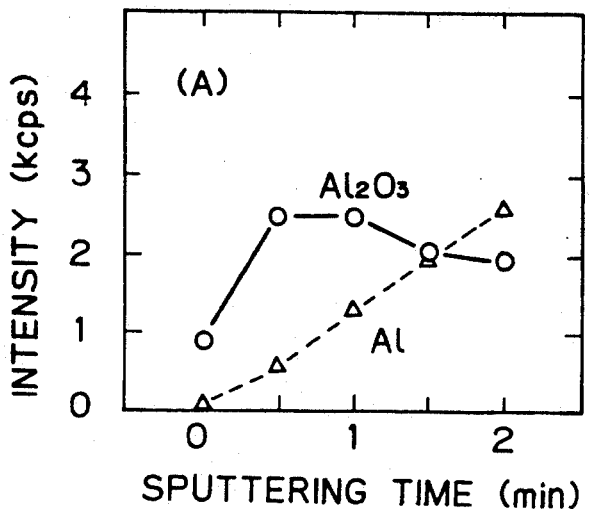
FIG. 2 is a graph showing the intensities of Al and $Al_2O_3$ peaks in the Al 2P spectrum of aluminum strip pretreated by a conventional process as a function of sputtering time while the strip was sputtered with argon from the outermost surface to a depth corresponding to a sputtering time of 2 minutes.
Figure 3:
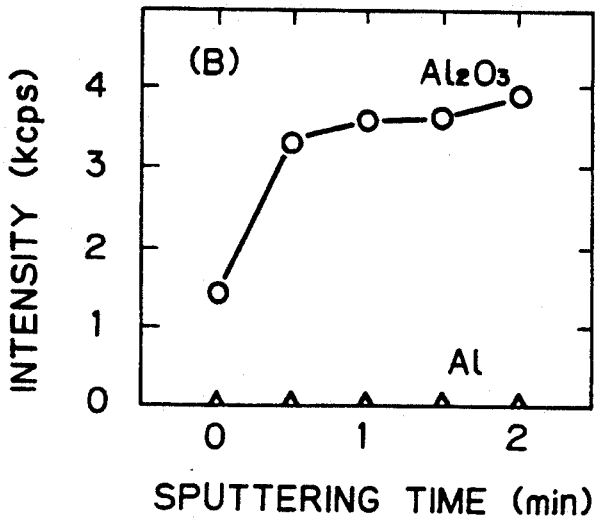
FIG. 3 is a similar graph of aluminum strip further treated by anodic electrolysis according to the process of this invention.

FIGS. 2 and 3 show the intensities of Al and $Al_2O_3$ peaks in the Al 2P spectra (A) and (B), respectively, as a function of sputtering time while the sample was sputtered with argon from the outermost surface to a depth corresponding to a sputtering time of 2 minutes. These figures well support the above-described difference in the oxide film between the as-pretreated sample and the sample further anodized in an acidic plating bath. Thus, the intensity of the Al peak increases with sputtering time in FIG. 2 (conventional process). In contrast, it is maintained at substantially zero throughout the sputtering for 2 minutes, and the intensity of $Al_2O_3$ peak gradually increases with time in FIG. 3 (the process of this invention).

Also it is found that there is another difference between the spectrum of as-pretreated sample (A) and that of anodized sample (B) with respect to the bond energy of $Al_2O_3$, i.e., oxide film of (A) and anodized film of (B). The bond energy is around 75.4 eV for (A) and 76.0 eV for (B). This difference is considered to arise from that the anodized film of (B) is porous.

Figure 4:
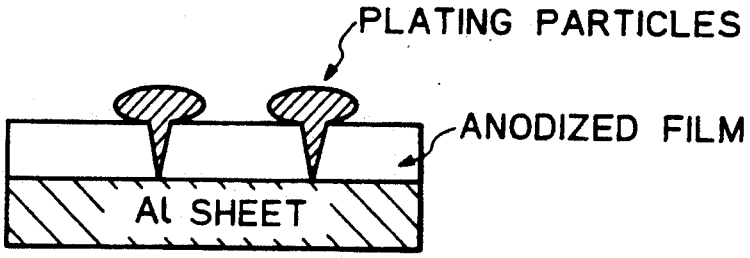
FIG. 4 is a schematic illustration showing the surface of aluminum strip which has been subjected to anodic electrolysis in an acid solution.

Thus, it can be concluded that an oxide film existing on the surface of as-pretreated aluminum strip (conventional pretreatment) has poor adhesion to a zinc plating formed thereon, while an anodized film existing after the aluminum strip is anodically electrolyzed in an acidic plating bath according to this invention has good adhesion thereto. This difference is considered to result from the fact that, unlike the oxide film found on the surface of as-pretreated aluminum, the oxide film formed by anodizing (anodic electrolysis) according to the invention is an amorphous, porous film, thereby producing an anchoring effect of a plated coating deposited thereon as schematically shown in FIG. 4 and leading to an improvement in adhesion of the plated coating.

Anodic electrolysis is already employed in electroplating of steel strip. However, the function of anodic electrolysis of steel strip before electroplating is merely to remove the surface oxide film or surface material of the steel strip, which is essentially different from the above-described mechanism of improvement in plating adhesion of aluminum strip achieved according to this invention.

It is also known that anodic treatment is performed on aluminum as electrochemical pretreatment to form a porous oxide film on the aluminum surface prior to electroplating. See Japanese Patent Application Laid-Open (Kokai) 51-64629(1976), 53-102840(1978), and 54-126637(1979). Unlike the anodic electrolysis employed in the present invention, such anodic treatment requires a prolonged period of time on the order of 10 to 30 minutes or longer so as to form a relatively thick porous anodized film having a thickness of 5 to 30 μm (50,000 to 300,000 angstroms). In addition, it is necessary that the anodic treatment be followed by alkaline treatment. Therefore, it is difficult to incorporate the anodic treatment in a high-speed, continuous electroplating line as realized in the present invention. The mechanism of improvement in adhesion attained by the anodic treatment is also different from the present invention.

The anodic electrolysis is preferably performed for at least 0.2 seconds and not more than 180 seconds. A longer duration of anodic electrolysis is not advantageous with respect to plating adhesion, appearance, and economy. Generally satisfactory results are obtained by anodic electrolysis for 10 seconds or shorter. Preferably the duration of anodic electrolysis is at most several seconds and most preferably approximately 3 seconds.

The conditions for anodic electrolysis are not critical. For example, the following conditions are suitable for anodic electrolysis:

| | |
|---|---|
| Voltage: | 300 V or less, |
| Bath temperature: | 30–60° C., |
| Bath pH: | 4 or less, |
| Duration: | 0.2–180 seconds. |

When the voltage is above 300 V, local concentration of current may occur during anodic electrolysis, resulting in the formation of an uneven and non-uniform anodized film.

The anodic electrolysis may be performed in a pickling solution used in the pretreatment of aluminum strip or any acidic solution having a pH of 4 or less in place of an acidic zinc plating bath. Preferably the pH of the acidic solution is about 2.5 or less and most preferably between 1 and 2, e.g., approximately 1.

Following the anodic electrolysis, cathodic electrolysis is performed on the aluminum strip in an acidic zinc plating bath which may be the same plating bath used in the anodic electrolysis, thereby coating the strip with a zinc plating. The conditions for cathodic electrolysis, i.e., electroplating are not critical. Typical conditions therefor are as follows:

| | |
|---|---|
| Current density: | 5–100 A/dm$^2$, |
| Bath temperature: | 30–60° C., |
| Bath pH: | 2.5 or lower, |
| Coating weight: | 0.1–40 g/m$^2$. |

The acidic plating bath may be either a sulfate or chloride bath. As described above, the zinc plating includes pure zinc plating and zinc alloy plating. Thus, the plating bath may contain, in addition to $Zn^{2+}$ ions, ions of one or more other metals. Examples of metals which can be present in a zinc alloy plating are Ni, Fe, Co, and Cr. The addition of metal ions such as $Ni^{2+}$ ions or $Fe^{2+}$ ions may provide the resulting electroplated coating with still improved adhesion to the aluminum substrate.

The zinc-electroplated aluminum strip produced by a process according to the present invention has improved plating adhesion, thereby enabling the plated strip to be subjected to severe press forming. Therefore, it is suitable for use in the manufacture of automobile bodies.

Since the anodic electrolysis generally requires a very short treatment period on the order of at most several seconds, the process can be carried out continuously at a high speed. In addition, it can be performed following the same procedures used for electroplating of steel strip, i.e., alkaline degreasing, rinsing, pickling, rinsing, and zinc electroplating in an acidic plating bath. Therefore, an already-installed zinc electroplating line for steel strip can be used to apply zinc plating to aluminum strip by a process according to this invention.

The following example is given to further illustrate the invention. In the example, all percents are by weight unless otherwise indicated.

EXAMPLE

A 0.8 mm-thick aluminum sheet made of an Al-4.5Mg alloy suitable for use in the manufacture of automobile hoods was subjected to pretreatment in the following sequence.

(1) Alkaline degreasing: cathodic electrolysis for 6 seconds in an aqueous 7% sodium orthosilicate solution at 80° C.

(2) Rinsing with water.

(3) Pickling: dipping for 5 seconds in a 8% hydrochloric acid solution (pH 1.0) at 80° C.

(4) Rinsing with water.

In some runs (Runs Nos. 13–16), the pickling was performed with an 8% sulfuric acid solution (pH 1.0) at 70° C. by dipping (Run No. 14) or by cathodic electrolysis (Run No. 13) or by anodic electrolysis (Runs Nos. 15 and 16).

The pretreated aluminum sheet was then treated in an acidic zinc plating bath of the sulfate type, first by anodic electrolysis and then by cathodic electrolysis for electroplating under the conditions shown in Table 1. In Runs Nos. 1, 5, 9, and 13–14, the pretreated aluminum sheet was directly electroplated by cathodic electrolysis without anodic electrolysis.

The resulting zinc-plated aluminum sheet was evaluated for adhesion of the plated coating to the aluminum substrate by an Erichsen cupping test in the following manner. A lattice pattern-cut test piece was subjected to an Erichsen punch stretch to a depth of 7 mm. The punch-stretched portion was subjected to a pressure-sensitive adhesive tape peeling test and the adhesion was evaluated as follows based on the percent retention of plated coating remaining on the substrate after the tape peeling.

| Rating | % Retention |
|---|---|
| 1 (Excellent) | 100 |
| 2 (Good) | 95–99 |
| 3 (Moderate) | 90–94 |
| 4 (Poor) | 50–89 |
| 5 (Very Poor) | 0–49 |

The test results are also given in Table 1.

TABLE 1

| Run No. | Pickling solution: Acid[1)] | Pickling solution: Treating method | Plating bath (sulfate) Composition (g/l): Zn | Ni | Fe | pH | Temp (°C.) | Electrolysis in plating bath: Anodic (V × sec) | Cathodic: Current density (A/dm$^2$) | Cathodic: Coating weight (g/m$^2$) | Plating adhesion (Rating) | Remarks |
|---|---|---|---|---|---|---|---|---|---|---|---|---|
| 1 | HCl | Dipping[2)] | 90 | — | — | 1.8 | 50 | — | 70 | 20 | 5 | Comparative |
| 2 | " | " | " | — | — | " | " | 15 × 0.1 | " | " | 2 | This |
| 3 | " | " | " | — | — | " | " | 15 × 0.2 | " | " | 1 | invention |
| 4 | " | " | " | — | — | " | " | 15 × 3.0 | " | " | 1 | |
| 5 | HCl | Dipping[2)] | 30 | 55 | — | 1.6 | 55 | — | 70 | 20 | 3 | Comparative |
| 6 | " | " | " | " | — | " | " | 15 × 0.1 | " | " | 2 | This |
| 7 | " | " | " | " | — | " | " | 15 × 1.0 | " | " | 1 | invention |
| 8 | " | " | " | " | — | " | " | 15 × 3.0 | " | " | 1 | |
| 9 | HCl | Dipping[2)] | 45 | — | 50 | 1.6 | 50 | — | 70 | 20 | 3 | Comparative |
| 10 | " | " | " | — | " | " | " | 15 × 0.1 | " | " | 2 | This |
| 11 | " | " | " | — | " | " | " | 15 × 0.5 | " | " | 1 | invention |
| 12 | " | " | " | — | " | " | " | 15 × 3.0 | " | " | 1 | |
| 13 | $H_2SO_4$ | Cathodic[3)] | 30 | 55 | — | 1.6 | 55 | — | 70 | 20 | 3 | Comparative |
| 14 | " | Dipping[4)] | " | " | — | " | " | — | " | " | 3 | |
| 15 | " | Anodic[5)] | " | " | — | " | " | — | " | " | 1 | This |
| 16 | " | " | " | " | — | " | " | 15 × 3.0 | " | " | 1 | invention |

[1)]8% HCl at 80° C. or 8% $H_2SO_4$ at 70° C.; [2)]dipping for 5 sec; [3)]cathodic electrolysis at 15 V × 3.0 sec; [4)]dipping for 10 sec; [5)]anodic electrolysis at 15 V × 3.0 sec.

As can be seen from Table 1, the plating adhesion of the zinc-plated aluminum sheet obtained in each comparative run was unsatisfactory and had a rating of 3 to 5. In contrast, each of the zinc-plated aluminum sheets according to this invention had satisfactory adhesion with a rating of 1 or 2.

It can be seen from the results of Runs Nos. 15 and 16 that anodic electrolysis in a pickling solution with or without further anodic electrolysis in an acidic plating bath prior to electroplating improved the adhesion of a plated coating on aluminum in a similar manner.

As shown in Runs Nos. 2, 6, and 10, when the anodic electrolysis was performed for 0.1 seconds, the plating adhesion had a rating of 2, which was improved over comparative runs but inferior to the other runs according to this invention. This is considered to be attributable to the shorter duration of anodic electrolysis, which was insufficient to form an anodized film having an adequate thickness. Therefore, the duration of anodic electrolysis is preferably at least 0.2 seconds.

The principles, preferred embodiments and modes of operation of the present invention have been described in the foregoing specification. The invention, however, is not to be construed as limited to the particular forms disclosed, since these are to be regarded as illustrative rather than restrictive. Variations and modifications may be made by those skilled in the art without departing from the concept of the invention.

What is claimed is:

1. A process for zinc electroplating and press forming of aluminum strip into an automobile body panel comprising sequential steps of subjecting aluminum strip to anodic electrolysis in an acidic solution so as to form a porous aluminum oxide coating on the aluminum strip, forming a zinc coating on the aluminum strip by cathodic electrolysis in an acidic zinc plating bath, and press forming the aluminum strip into an automobile body panel, the acidic solution being an acidic plating bath solution used in the subsequent cathodic electrolysis.

2. The process of claim 1, wherein the aluminum strip is subjected to anodic electrolysis for a period between 0.2 and 180 seconds.

3. The process of claim 2, wherein the duration of anodic electrolysis is less than 10 seconds.

4. The process of claim 1, wherein the anodic electrolysis is performed at a voltage of 300 V or less.

5. The process of claim 1, wherein the acidic solution for anodic electrolysis has a pH of 4 or less.

6. The process of claim 5, wherein the acidic solution for anodic electrolysis has a pH of 2.5 or less.

7. The process of claim 1, wherein the aluminum oxide coating has a thickness of at least 100 angstroms and the zinc electroplating provides a zinc or a zinc alloy coating anchored in the porous aluminum oxide coating.

8. The process of claim 1, wherein the zinc plating bath is a sulfate or chloride bath.

9. A process for zinc electroplating and press forming of aluminum strip comprising sequential steps of pretreating aluminum strip by alkaline degreasing, pickling the aluminum strip, subjecting the aluminum strip to anodic electrolysis in an acidic solution so as to form a porous aluminum oxide coating on the aluminum strip, zinc electroplating the aluminum strip by cathodic electrolysis in an acidic zinc plating bath, and press forming the aluminum strip, the acidic solution being an acidic plating bath solution used in the subsequent cathodic electrolysis.

10. The process of claim 9, wherein the aluminum strip is subjected to anodic electrolysis for a period between 0.2 and 180 seconds.

11. The process of claim 10, wherein the duration of anodic electrolysis is less than 10 seconds.

12. The process of claim 9, wherein the anodic electrolysis is performed at a voltage of 300 V or less.

13. The process of claim 9, wherein the acidic solution for anodic electrolysis has a pH of 4 or less.

14. The process of claim 13, wherein the acidic solution for anodic electrolysis has a pH of 2.5 or less.

15. The process of claim 9, wherein a body panel of an automobile is formed during the press forming step.

16. The process of claim 9, wherein the aluminum oxide coating has a thickness of at least 100 angstroms and the zinc electroplating provides a zinc or a zinc alloy coating anchored in the porous aluminum oxide coating.

17. The process of claim 9, wherein the zinc plating bath is a sulfate or chloride bath.

* * * * *